United States Patent [19]

Hamilton

[11] Patent Number: 4,722,453

[45] Date of Patent: Feb. 2, 1988

[54] DATA STORAGE TRAY

[76] Inventor: Ross R. Hamilton, 527 Crescent Boulevard, SW., Calgary, Alberta, Canada, T2S 1K8

[21] Appl. No.: 795,286

[22] Filed: Nov. 5, 1985

[51] Int. Cl.[4] ..... B42F 17/12

[52] U.S. Cl. ..... 220/22.3; 220/22.5; 206/425

[58] Field of Search ..... 220/22.3, 22.5; 206/425

[56] References Cited

U.S. PATENT DOCUMENTS

| | | | |
|---|---|---|---|
| 1,808,475 | 6/1931 | Oyen | 220/22.3 |
| 2,610,759 | 9/1952 | Slade | 220/22.3 |
| 2,781,125 | 2/1957 | Mills | 220/22.3 X |
| 2,985,333 | 5/1961 | Kirkman | 220/22.3 |
| 4,366,904 | 1/1983 | Roskvist | 220/22.3 X |
| 4,527,222 | 7/1985 | Swingley, Jr. | 220/22.5 X |

*Primary Examiner*—Steven M. Pollard

*Attorney, Agent, or Firm*—Harold H. Dutton, Jr.; George H. Dunsmuir

[57] ABSTRACT

The problem of storing microfiche transparencies, cards, documents, photographs or any other sheets of material in the vertical or inclined position, is solved by a simple rectangular tray with inclined ends and side walls, the inner top portions of which contain vertically extending grooves for receiving a pair of lugs on each side of planar rectangular partitions. The spacing between the lugs is such that the partition is inclined by no more than 30° from the vertical when the lugs on one side of the partition are inserted into adjacent grooves. In the vertical position the lugs are vertically aligned in the same plane as the body of the partition.

4 Claims, 4 Drawing Figures

DATA STORAGE TRAY

BACKGROUND OF THE INVENTION

This invention relates to a tray for holding thin sheets of material, and in particular to a microfiche tray.

Canadian Pat. No. 1,090,228 which issued to R. B. Morris on 25 Nov. 1980 discloses a microfiche tray including dividers or partitions removably mounted in the tray, for separating groups of microfiche transparencies. The patent includes reference to the prior art, namely U.S. Pat. Nos. 1,939,651 issued to J. E. Bales on 19 Dec. 1933; 2,459,561 issued to H. H. Yawman on 18 Jan. 1949 and 2,586,925 issued to V. Drengberg on 26 Feb. 1952. The Canadian patent offers a solution to the problem of storing microfiche in the vertical or inclined positions. The solution offered by the Canadian patent is somewhat complicated in that it involves the use of slotted side bars, which must be manufactured separately and mounted in the tray. It is believed that there is still room for improvement in the art in question.

The object of the present invention is to provide a solution to the problem, in the form of a relatively simple microfiche tray and partition structure, which is easy to manufacture and use.

BRIEF SUMMARY OF THE INVENTION

Accordingly the present invention relates to a tray for microfiche or other thin sheets of material, comprising a bottom wall; parallel, spaced apart side walls extending upwardly from said bottom wall; end walls connected to the ends of said side walls and extending upwardly from said bottom wall; a plurality of vertical grooves in at least a top portion of each said side wall; and at least one partition for insertion into the tray, said partition including substantially planar body means and lug means extending outwardly from the sides of said body, for insertion into said grooves for retaining said partition in a vertical or inclined position.

BRIEF DESCRIPTION OF THE DRAWINGS

The invention will now be described in greater detail with reference to the accompanying drawings, which illustrate a preferred embodiment of the invention and wherein.

DESCRIPTION OF THE PREFERRED EMBODIMENT(S)

Figure 1:
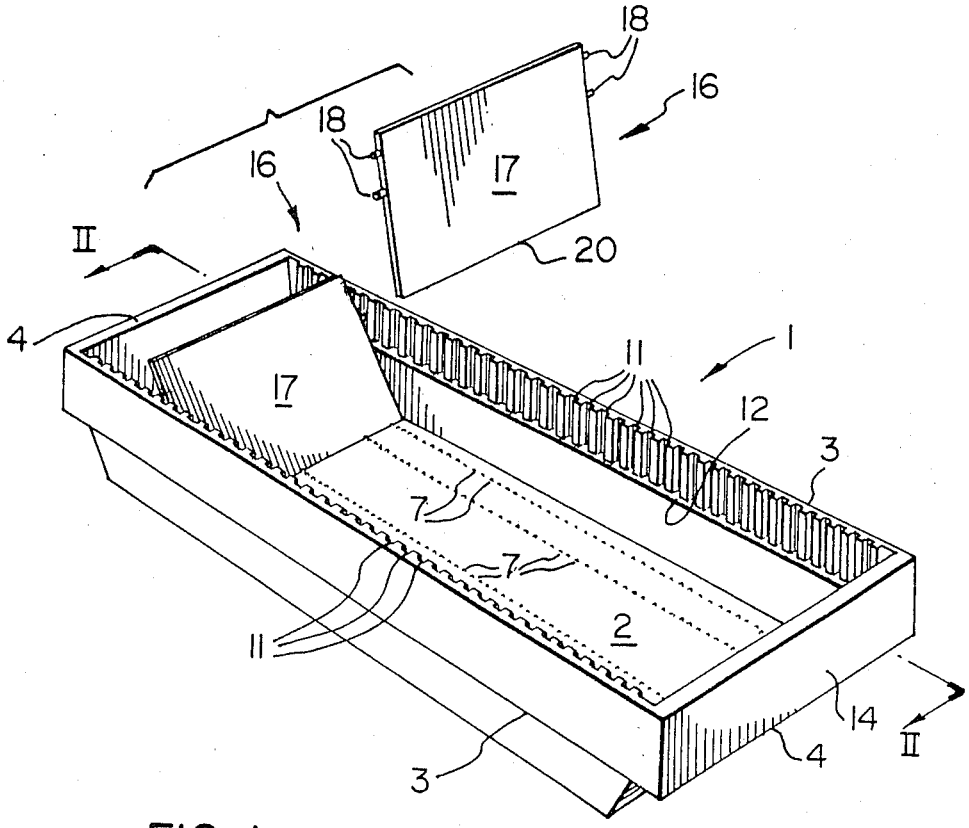
FIG. 1 is an exploded, perspective view from above of a tray and partitions in accordance with the present invention.

With reference to the drawings, the tray of the present invention which is generally indicated at 1 includes a bottom wall 2, a pair of vertical side walls 3 integral with and extending upwardly from the bottom wall 2, and a pair of inclined end walls 4 integral with the bottom and side walls 2 and 3 respectively.

The bottom wall 2 is planar with a pair of longitudinally extending projections 6 defining feet on the bottom surface thereof. Four parallel, longitudinally extending rows of small lugs or beads 7 are provided on the top surface of the bottom wall 2. The side walls are defined by upwardly and outwardly inclined bottom portions 9 and thicker, vertical upper portions 10. The inner surface of each upper portion 10 of the side walls

3 includes rectangular, vertical grooves 11 along the entire length thereof. The grooves 11 extend downwardly from the flat upper edge of each side wall to a horizontal shoulder 12 at the bottom end of the top portion of the wall 3.

Figure 2:
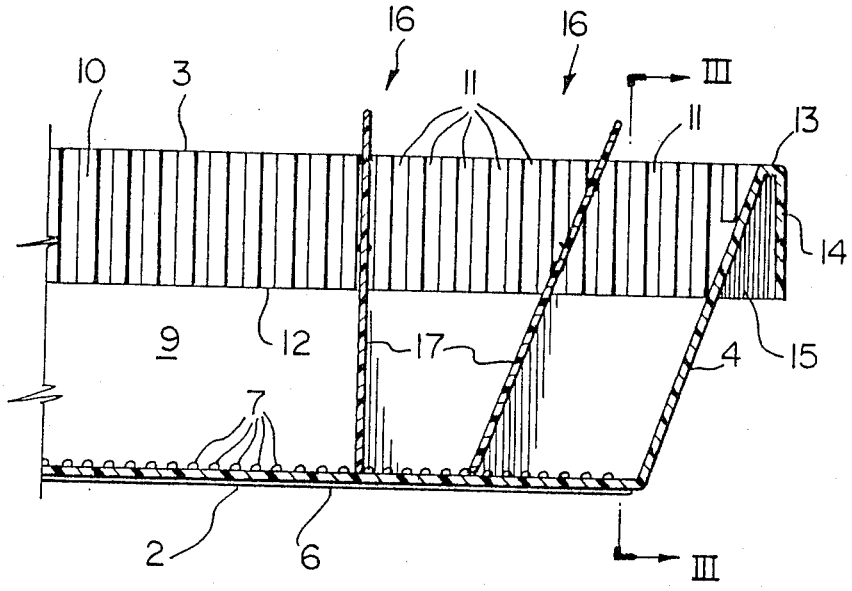
FIG. 2 is a cross section of one end of the tray, taken generally along line II—II of FIG. 1.
Figure 3:
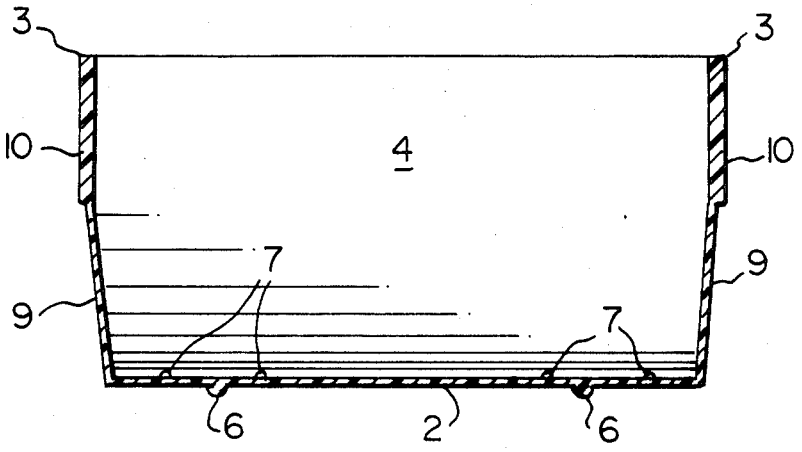
FIG. 3 is a cross section taken generally along line III—III of FIG. 2.
Figure 4:
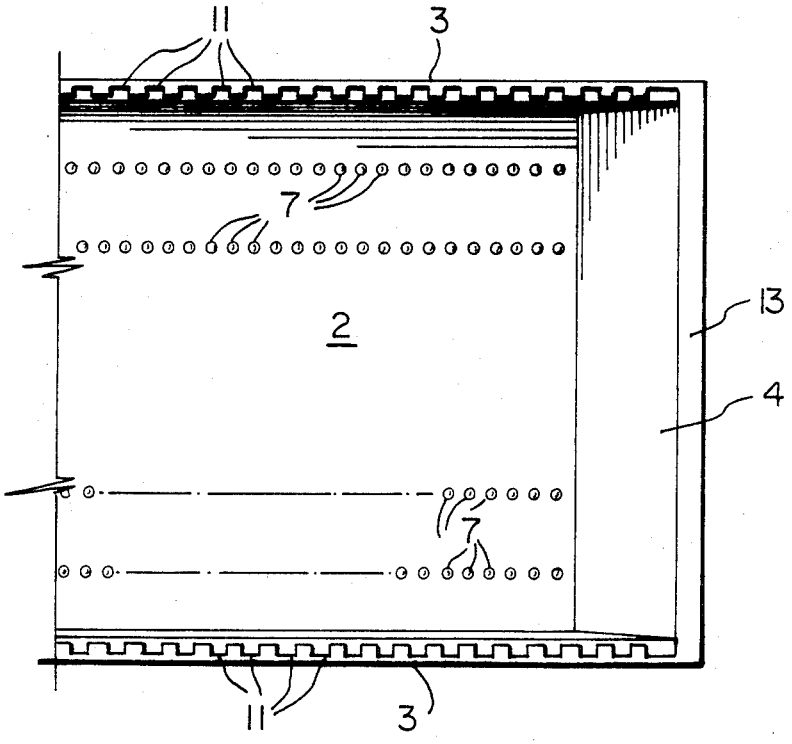
FIG. 4 is a plan view of one end of the tray of FIGS. 1 to 3.

A flat upper end 13 and a downwardly extending flange 14 are provided on the inclined walls 4 for strengthening the latter. The ends of the flange 14 are connected to the upper portions 10 of the side walls by triangular webs 15 of material (FIG. 2) integral with such ends and side walls 4 providing a symmetrical shape to the tray. Of course, the webs 15 also strengthen the structure.

A plurality of partitions, generally indicated at 16 are provided for insertion into the tray. Each partition is defined by a planar rectangular body 17, with a pair of lugs 18 extending outwardly from the top of each side edge thereof. The width of the partition 17 is less than the distance between the bottom ends of the walls 3. The lugs 18 extend outwardly from the sides of the body 17 a distance sufficient that such lugs slide in the grooves 11 in the opposed side walls 3 when the partition 16 is inserted into the tray. It will be appreciated that the partition 16 can be inserted vertically into the tray. Alternatively, the partition 16 can be inclined in the tray. For such purpose, the spacing between the lugs 18 is such that the lugs on each side of the body 17 of the partition 16 can be inserted in adjacent grooves 11, and the partition 16 slid downwardly until the bottom edge 20 thereof engages the bottom wall 2 adjacent to a transversely extending row of beads 7. The spacing between the lugs 18 on each side of the body 17 is such that the partition is inclined by no more than 30° from the vertical. Of course, the angle of inclination of the partition 16, which is dictated by the spacing between the lugs 18, can readily be changed by altering the spacing between the lugs.

Thus, there has been described a relatively simple microfiche tray for storing microfiche in the vertical or inclined position.

What I claim is:

1. A storage tray for microfiche or other thin sheets of material, comprising a bottom wall; parallel spaced apart side walls extending upwardly from said bottom wall; end walls connected to the ends of said side walls and extending upwardly from said bottom wall; a plurality of vertical grooves in at least a top portion of each said side wall; and at least one partition for insertion into the tray, said partition including substantially planar body means and a pair of lug members near the top of and extending outwardly from each side of said body, whereby upon insertion of said body means into said tray, each lug of each pair may slide into the same one of said grooves for retaining said partition in a vertical position, and each lug of each pair may slide into a different one of said grooves for retaining said partition in an inclined position.

2. A tray according to claim 1 wherein each said side wall includes a horizontal shoulder at the bottom of said top portion, said grooves extending vertically from a top edge of each side wall to said shoulder.

3. A tray according to claim 1 wherein said end walls are inclined outwardly, the angle of inclination of said end walls being substantially identical to the angle of inclination of said partition in the inclined position.

4. A tray according to claim 1, 2 or 3 including upwardly extending bead means on the top surface of said bottom wall for retaining the bottom end of said partition in one position.

* * * * *